US007592961B2

(12) United States Patent
Thober et al.

(10) Patent No.: US 7,592,961 B2
(45) Date of Patent: Sep. 22, 2009

(54) SELF-TUNING RADIO FREQUENCY IDENTIFICATION ANTENNA SYSTEM

(75) Inventors: Dario Sassi Thober, Alphaville (BR); Wellington de Oliveira Giolo, Campinas (BR); Jerome Breche, Huntsville, AL (US); Thiago Cardoso, Alphaville (BR); Alecio Fernandes, Alphaville (BR); Ademir Xavier, Alphaville (BR)

(73) Assignee: Sanimina-Sci Corporation, San Jose, CA (US)

( * ) Notice: Subject to any disclaimer, the term of this patent is extended or adjusted under 35 U.S.C. 154(b) by 413 days.

(21) Appl. No.: 11/357,679

(22) Filed: Feb. 16, 2006

(65) Prior Publication Data

US 2007/0091006 A1 Apr. 26, 2007

Related U.S. Application Data

(60) Provisional application No. 60/729,281, filed on Oct. 21, 2005.

(51) Int. Cl.
*H01Q 1/38* (2006.01)

(52) U.S. Cl. ..... 343/745; 343/750; 343/860; 343/861

(58) Field of Classification Search ..... 343/745, 343/750, 860, 861
See application file for complete search history.

(56) References Cited

U.S. PATENT DOCUMENTS

| | | | | |
|---|---|---|---|---|
| 4,799,066 | A * | 1/1989 | Deacon | 343/861 |
| 6,570,462 | B2 * | 5/2003 | Edmonson et al. | 333/17.3 |
| 2006/0252391 | A1 * | 11/2006 | Poilasne | 455/121 |

* cited by examiner

*Primary Examiner*—Tho G Phan
(74) *Attorney, Agent, or Firm*—Lorza & Lorza, LLP; Julio M. Loza

(57) ABSTRACT

A self-tuning antenna that automatically adjusts its input impedance to compensate for externally induced impedance variations is provided. A variable impedance is adjusted by a control circuit to reconfigure the input impedance of than antenna to compensate for different environmental situations and different transponder mismatch situations. A negative-feedback signal is employed to determine or infer impedance mismatches and reconfigure the antenna input impedance (e.g., capacitance and/or resistance) until a desired equilibrium of the antenna input impedance is reached. A reference measurement (e.g., VSWR measurement) is automatically performed by an antenna tuning circuit that adjusts the antenna's impedance matching circuit to compensate for object interference. The antenna's impedance matching circuit includes a variable capacitor circuit having a plurality of individually controlled parallel plate capacitors that can be added or removed from the variable capacitor circuit, as necessary.

12 Claims, 6 Drawing Sheets

Cx - Capacitors

Rx – Relays/Switch

Sx – Select Lines

SELF-TUNING RADIO FREQUENCY IDENTIFICATION ANTENNA SYSTEM

CLAIM OF PRIORITY

The present Application for Patent claims priority to Provisional Application No. 60/729,281 entitled "Self-Tuning Radio Frequency Identification Antenna System" filed Oct. 21, 2005, and assigned to the assignee hereof and hereby expressly incorporated by reference.

FIELD

Various embodiments of the invention pertain to antennas and more specifically to antennas with self-tuning input impedances for radio frequency identification.

BACKGROUND

Radio frequency identification (RFID) devices are increasingly employed in identification applications. Such RFID applications typically include an RFID device (e.g., RFID-enabled tag, label, etc.) having an identification circuit, a transponder and an antenna that communicate with an RFID reader to identify the RFID device. RFID readers may be deployed at point of sale locations, for instance, to identify goods bearing an RFID device (e.g., tag). In deploying such RFID readers, the location and operating conditions of the readers may vary significantly. Ideally, RFID readers would be placed in electromagnetic-compatible spaces, free of interference from other systems and naturally-induced shielding due to metal parts surrounding the RFID reader antenna and/or the transponder of the RFED device. However, in real-world applications, RFID readers are often installed in environments in which electromagnetic shielding and/or disturbances may occur. When a large conducting body or electric mass is placed in proximity to an RFID reader antenna, it tends affects the electromagnetic or radio characteristics of the typical antenna. For example, an RFID reader may be installed at or near a checkout station, adjacent to one or more electromagnetic shielding or interfering surfaces and/or objects. These types of external bodies tend to cause environmentally induced impedance variations on the RFID reader antenna.

For example, variations of input impedance may be caused by reflected electromagnetic fields. The presence of metallic structures or objects proximate a transmitting antenna tends to cause electromagnetic field scattering, including reflected electromagnetic fields, that contributes to alter the current distribution in the antenna. For instance, the reflected electromagnetic fields may induce additive and/or subtractive currents in the transmitting antenna. Such scattering and/or reflection manifests itself (on the transmitting antenna) as impedance mismatches. Additionally, in some implementations, the transmitting antenna may also be affected by minor background electromagnetic radiation (e.g., shortwave band of 13.56 MHz for an RFID receptor).

In order to counteract these externally induced impedance variations, the RFID reader antenna is typically manually adjusted, at installation for instance, for a particular environment using a separate instrument, such as a Voltage Standing Wave Ratio (VSWR) meter. After initial installation, it may be necessary to readjust the reader, over time, due to the presence of new objects or materials (e.g., shelves, people, or other products) that accumulate near the RFID reader antenna and affect the operation of the RFID reader. Thus, a solution is needed that adjusts the operation of the RFID antenna to approximately maintain a particular antenna impedance.

SUMMARY

The invention provides a system and method that automatically adjusts the input impedance of an antenna to compensate for externally induced impedance variations. One implementation of the present invention provides a novel self-tuning antenna having a digitally controlled adjustable impedance capable of reshaping or reconfiguring itself to compensate for different environmental situations and different transponder mismatch situations. A negative-feedback system is employed to determine impedance mismatches and provide a reference signal to reconfigure the antenna impedance (e.g., capacitance and/or resistance) until a desired equilibrium of the antenna input impedance is reached. A reference measurement (e.g., VSWR measurement) is automatically done by an antenna tuning circuit that adjusts the antenna's impedance matching circuit to compensate for object interference. The antenna's impedance matching circuit includes a variable capacitor circuit that is switched by a controller, up or down as necessary, based on a feedback reference coming from a VSWR meter.

Several novel features of the present invention provide (a) a self-tuning antenna that compensates for impedance mismatch, (b) an automated micro-controlled digital capacitor matching circuit, and (c) and an indirect Voltage Standing Wave Ratio (VSWR) determination scheme.

A self-tuning antenna is provided including (a) a main antenna, (b) an impedance compensation circuit coupled to the main antenna to vary the input impedance of the main antenna, and (c) a controller coupled to the main antenna and impedance compensation circuit to automatically determine when an impedance mismatch occurs on the main antenna and automatically adjust the impedance compensation circuit to minimize the impedance mismatch. The controller may periodically or continuously monitor one or more dynamic characteristics of the main antenna to determine if the input impedance of the main antenna should be adjusted. The impedance compensation circuit may include a digital variable capacitor that is adjusted by the controller to minimize impedance mismatch. The digital variable capacitor may include a plurality of individually controlled capacitors, such as individually controllable parallel plate capacitors, that are added or removed from the impedance compensation circuit by the controller. In one implementation, a voltage standing wave ratio (VSWR) meter coupled to the main antenna to provide a signal to the controller indicative of impedance mismatch for the main antenna. In another implementation, a secondary antenna positioned adjacent to the main antenna to sense the electromagnetic radiation in the vicinity of the main antenna and provide a signal indicative of impedance mismatch for the main antenna. The controller senses an induced current on the secondary antenna indicative of the sensed electromagnetic radiation. A transmission signal of known frequency may be used to determine the electromagnetic radiation of the main antenna.

Another embodiment of the invention provides an antenna tuning device having (a) an impedance compensation circuit to vary the input impedance of an antenna, and (b) a controller coupled to the impedance compensation circuit to automatically adjust the impedance compensation circuit based on a feedback signal. In various implementations, the antenna tuning device may also include (a) a voltage standing wave ratio (VSWR) detector to provide the feedback signal to the controller indicative of an impedance mismatch for the antenna, or (b) a secondary antenna positioned adjacent to the antenna to sense the electromagnetic radiation of the antenna and provide a signal indicative of impedance mismatch for the main antenna, wherein the controller receives the signal from the second antenna and infers a voltage standing wave ratio for the antenna based on the signal. The impedance compensation circuit may include a digital variable capacitor having plurality of individually controlled capacitors that are added or removed from the impedance compensation circuit by the controller to obtain a desired impedance match.

Another aspect of the invention provides a digital variable capacitor for a self-tuning antenna including (a) a plurality of parallel plate capacitors formed on opposite surfaces of a circuit board, the plurality of parallel plate capacitors coupled to each other in parallel, and (b) a plurality of switches, each switch coupled in series to a corresponding parallel plate capacitor and individually adjustable to activate or deactivate its corresponding parallel plate capacitor. The switches are dynamically adjusted to provide a single capacitance for the digital variable capacitor.

In another implementation, an antenna tuning system includes (a) a first antenna, (b) a second antenna in proximity to the first antenna to capture radio frequency radiations from the first antenna, (c) a controller coupled to the second antenna to receive a feedback signal from the second antenna and adjust the input impedance of the first antenna to minimize impedance mismatch for the first antenna, and/or (d) an impedance compensation circuit coupled to the first antenna and the controller, the controller configured adjust the impedance compensation circuit to vary the input impedance of the first antenna.

One aspect of the invention provides a method for automatically tuning an antenna, including the steps of (a) automatically determining whether the antenna has an impedance mismatch, and (b) automatically adjusting a variable capacitor to change the input impedance for the antenna and compensate for the impedance mismatch. The impedance mismatch may be indirectly determined based on the radiation from the antenna.

DETAILED DESCRIPTION

In the following description numerous specific details are set forth in order to provide a thorough understanding of the invention. However, one skilled in the art would recognize that the invention might be practiced without these specific details. In other instances, well known methods, procedures, and/or components have not been described in detail so as not to unnecessarily obscure aspects of the invention.

In the following description, specific details are given to provide a thorough understanding of the embodiments. However, it will be understood by one of ordinary skill in the art that the embodiments may be practiced without these specific detail. For example, circuits may be shown in block diagrams in order not to obscure the embodiments in unnecessary detail. In other instances, well-known circuits, structures and techniques may not be shown in detail so as not to obscure the embodiments.

The invention provides a system and method that automatically adjusts the input impedance of an antenna to compensate for externally induced impedance variations. One implementation of the present invention provides a novel self-tuning antenna having a digitally controlled adjustable impedance capable of reshaping or reconfiguring itself to compensate for different environmental situations and different transponder mismatch situations. A negative-feedback system is employed to determine impedance mismatches and provide a reference signal to reconfigure the antenna impedance (e.g., capacitance and/or resistance) until a desired equilibrium of the antenna input impedance is reached. A reference measurement (e.g., VSWR measurement) is automatically done by an antenna tuning circuit that adjusts the antenna's impedance matching circuit to compensate for object interference. The antenna's impedance matching circuit includes a variable capacitor circuit that is switched by a controller, up or down as necessary, based on a feedback reference coming from a VSWR meter.

Several novel features of the present invention provide (a) a self-tuning antenna that compensates for impedance mismatch, (b) an automated micro-controlled digital capacitor matching circuit and (c) and an indirect Voltage Standing Wave Ratio (VSWR) determination scheme.

Self-Tuning Antenna

Figure 1:
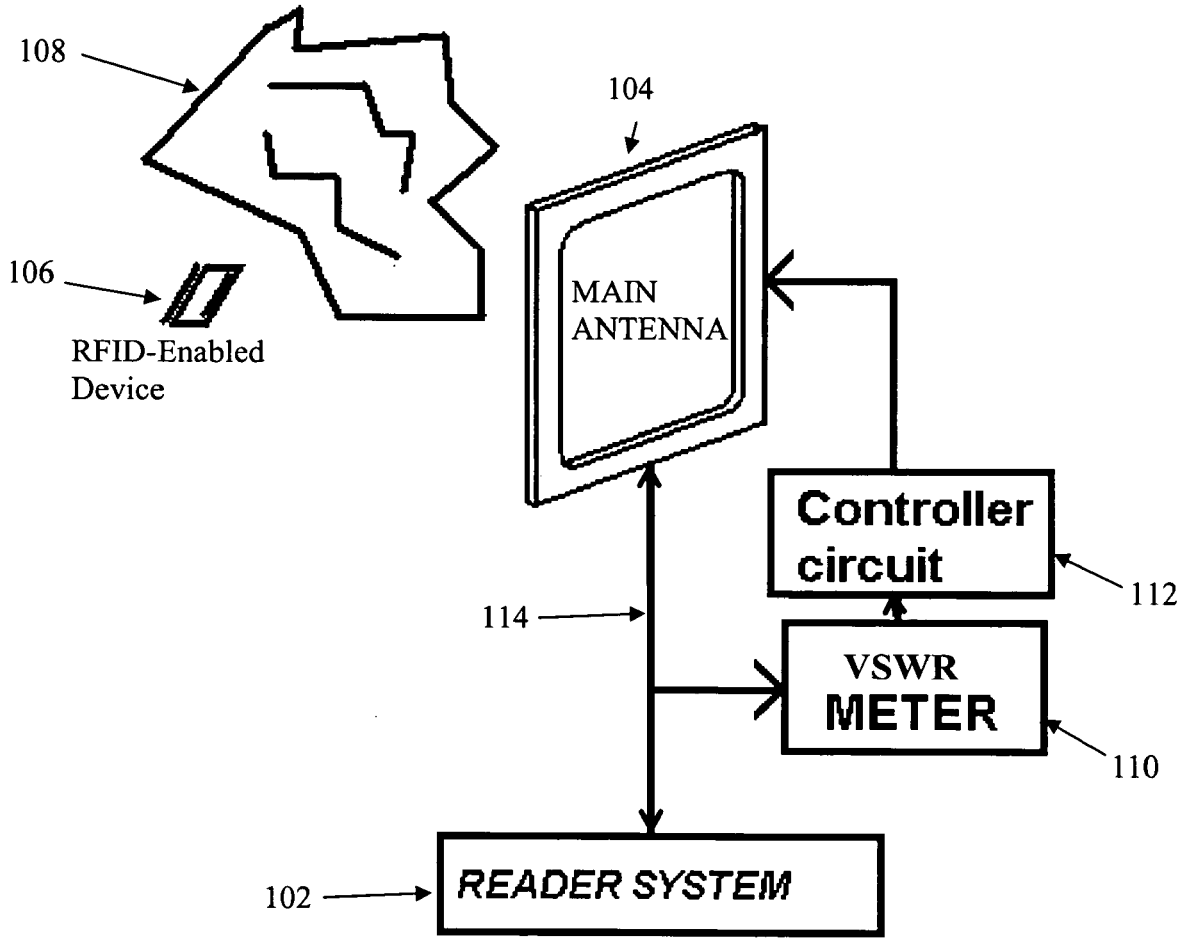
FIG. 1 illustrates an environment in which a self-tuning antenna having automatic impedance mismatch compensation may be implemented according to one embodiment of the invention.

FIG. 1 is a block diagram illustrating an environment in which a self-tuning antenna having automatic impedance mismatch compensation may be implemented according to one embodiment of the invention. An RFID reader system 102 is coupled to a main reader antenna 104 which is used to read identifiers from RFID-enabled devices 106. When a large conducting body (e.g., metallic plate) or electromagnetic generating or blocking mass 108 is placed close to the main antenna 104, it tends to affect the electromagnetic or radio characteristics of the antenna 104. The conducting body or electromagnetic-generating mass 108 may be, for example, other nearby antennas or metallic/dense structures. Such mass 108 may cause electromagnetic waves transmitted by the antenna 104 to be scattered and/or reflected, which may result in variations or changes in the perceived input impedance of the antenna 104.

One embodiment of the invention automatically adjusts the main antenna's 104 input impedance, as perceived by the RFID reader system 102, to maintain it at approximately a fixed value (e.g., a value providing maximum gain) by changing the capacitance of the main antenna 104. The main antenna 104 may be a loop antenna having two terminals across which the antenna's input impedance is measured. The RFID reader system's 102 relative power loss is directly related to the impedance mismatch of the modulus of the gamma factor of the equation of VSWR (Voltage Standing Wave Ratio):

$$VSWR = \frac{1+|\Gamma|}{1-|\Gamma|}, \text{ where } \Gamma = \frac{Z-Z_c}{Z+Z_c},$$

Zc—Line impedance between reader system and antenna
Z—Antenna input impedance

Maximum power is transmitted by the reader system 102 if $\Gamma=0$, that is if $Z=Z_c$. The antenna's 104 input impedance is reconfigured, as needed, to match to the line impedance for the optimal environment case. The optimal case occurs when the main antenna 104 is far from any potential conducting body (e.g., surfaces of conducting objects) or electromagnetic generating or blocking mass (e.g., energy sources, electric motors, etc.) or other interference sources.

To maintain and adjust the antenna impedance at a desired value, the system includes a VSWR meter 110, to determine when an impedance mismatch occurs, and an impedance controller circuit 112, to automatically adjust the antenna's 104 input impedance. The VSWR measurement obtained by the VSWR meter 110 is used to determine the degree of impedance mismatch during the operation of the reader system 102. By construction, the VSWR meter 110 does not decrease (or decreases minimally) the overall performance of the reader-antenna line 114. That is, the VSWR meter 110 may be designed to minimize resistance and/or capacitive loading of the reader-antenna line 114.

In one implementation, the VSWR meter 110 directly measures a voltage standing wave ratio (VSWR) on the line 114 and provides it to the controller circuit 112 which actuates the main antenna 104 tuning circuit that adjusts the antenna input impedance. The degree of impedance mismatch is measured on the transmission line 114 to determine the presence of a perturbation in the electromagnetic environment in which the main antenna 104 operates. A VSWR meter 110 measures the degree of impedance mismatch during the process of reading by the reader system 102.

In alternative implementations, the system may indirectly measure or infer the VSWR measurement from the field intensity radiated by the main antenna 104. For example, the field intensity may be detected by a second antenna (e.g., spiral loop) placed near the main antenna 104. This indirect way of measuring impedance mismatch is less intrusive and has lower loss when compared with an in-circuit VSWR measurement.

The controller circuit 112 adjusts the antenna's 104 input impedance only if an impedance mismatch is determined from the VSWR measurements. The electrical current on the transmission line 114 is converted to a proportional voltage signal and then amplified by an operational amplifier. This proportional voltage detected by the VSWR meter 110 is proportional to the amount of obstacle interference experienced by the antenna 104. Therefore, this detected voltage is used to set the input impedance matching circuit of the antenna 104 to adjust the antenna's perceived input impedance to a suitable value. The analog voltage signal (from the VSWR meter) is read and interpreted by the controller circuit 112 which has an embedded analog-to-digital (A/D) converter. The controller circuit 112 may be configured to provide optimal performance with the various VSWR ranges and provide a feedback signal to an impedance matching circuit for the antenna 104.

In some implementations, the VSWR measurement and feedback adjustment for self-tuning antennas may operate with systems based on loop antennas. Therefore, the same principle of measurement and circuit adjustment can be extended to other products such as low frequency RFID systems working at about 125 KHz-140 KHz and higher frequency RFID systems with operation frequencies close to 1 GHz. With higher frequencies, the improvement in the performance provided by the impedance adjustment is better since the wavelength becomes shorter and the loop antenna systems become progressively more affected by environmental noise or interference.

The VSWR meter 110 and the feedback controller circuit 112 permit construction of a self-tuning RFID reader device capable of reducing the system sensitivity to environmental effects that can deteriorate the reading quality of the identification process. The reading system 102 then becomes less affected by external noise and the presence of metallic objects close to the main antenna 104.

The present invention may also dispense with the reader impedance calibration during the installation phase which is often carried out to provide initial impedance matching between the main antenna 104 and the reading system 102. Impedance matching may be actively performed during the reading operation of the reading system 102 (e.g., when signals of a known frequency are transmitted by the system through antenna 104). Thus, impedance stability for the antenna 104 is reached throughout the RFID system working life, minimizing maintenance operations and re-tuning upon any change of the RFID reader system and/or antenna location.

Indirect VSWR Measurements

Another feature of this invention provides a non-intrusive, indirect way of obtaining VSWR measurements to determine whether there is an impedance mismatch between an antenna and a reader. A VSWR value, estimate, or measurement is used to correct the impedance of the antenna as needed. Rather than obtaining a direct measurement as illustrated in FIG. 1, the VSWR value may be inferred through the field intensity radiated by the antenna.

VSWR meters typically employed for calibration often cause additional interference in a system due to reflection and line loading. This is because the VSWR meter is coupled directly on the line between the reader and antenna. When impedance matching is performed on a conventional RFID reader's antenna, a VSWR meter and an operator, who acts as the feedback mechanism, are often needed to tune the RFID reader system. Adjustments are manually made to an impedance-matching circuit, which is generally located at the signal input of an antenna. Such impedance matching circuits often include an adjustable capacitor, inductor and/or resistor which are tuned-up to the point where the VSWR is nearest to "1" (e.g., impedance is matched).

In one implementation of the invention, the main antenna impedance measurement is made off-line by injecting a reference signal of known frequency (e.g., approximately 13.56 MHz frequency signal) into the system for transmission via the antenna. In other implementations, the measurements (e.g., induced current on an adjacent secondary antenna) are made during normal operation of the reader system as a signal of known frequency is transmitted via the antenna. Based on the current induced on a secondary antenna, positioned proximate or adjacent the main antenna, the main antenna impedance input impedance is adjusted as needed.

Figure 2:
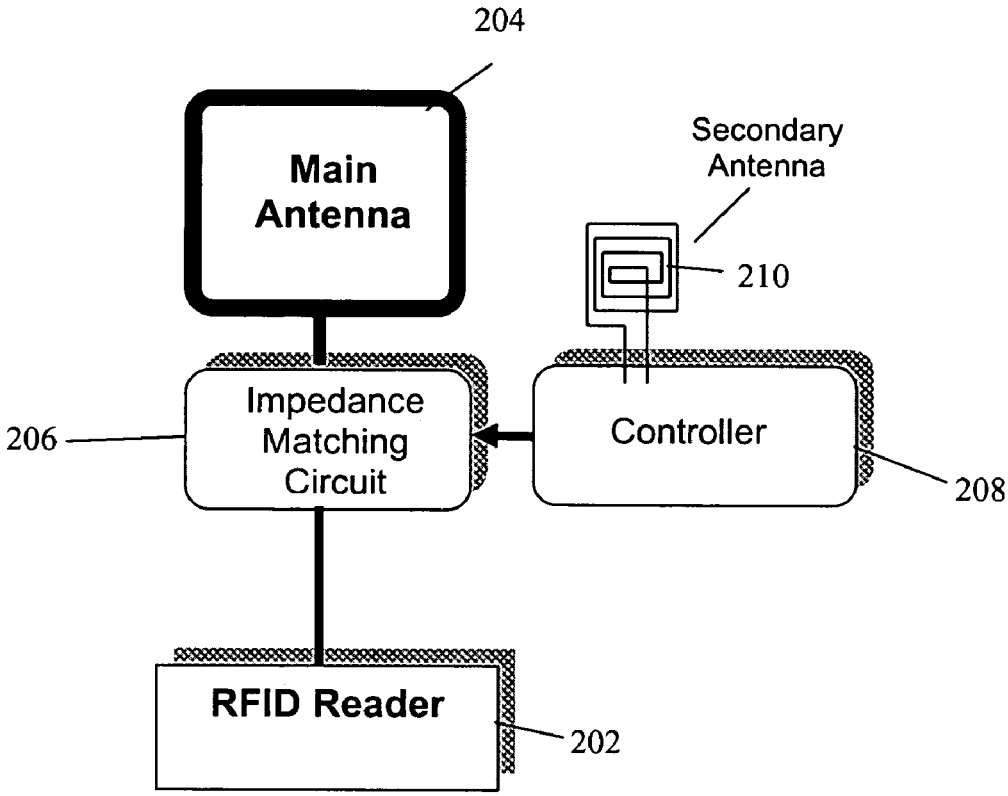
FIG. 2 is a block diagram illustrating a system that indirectly determines a voltage standing wave ratio for an antenna to automatically correct the antenna's input impedance, if necessary.

FIG. 2 is a block diagram illustrating a system that indirectly determines a compensation value for a main antenna 204 to automatically correct the antenna's input impedance, if necessary. This system includes an RFID reader 202 coupled to a main antenna 204 with an impedance matching circuit 206 coupled between the RFID reader 202 and main antenna 204 at or near the main antenna 204 input. The main antenna 204 is the antenna used by the RFID reader 202 to transmit and/or receive RF signals. A controller 208 is coupled to a secondary antenna 210 and the impedance matching circuit 206. The secondary antenna 210 is mounted near (e.g., in front or in back of) the main antenna 204 to sense the electromagnetic field intensity radiated by the main antenna 204 and/or scattered or reflected radiation. This secondary antenna 210 may exhibit an induced current (e.g., from the electromagnetic radiation scattering, and/or reflection) that can be used by the controller 208 to adjust the impedance matching circuit 206 accordingly. In one implementation, the controller 208 dynamically estimates a correction value, based on the induced current on the secondary antenna 210, to adjust the input impedance of the main antenna 204.

Rather than performing a direct measurement on the main antenna 204 transmission link to the RFID reader 202, a feedback correction value may be inferred based on the field intensity radiated by the main antenna 204. The detected electromagnetic field is proportional to the amount of obstacle interference perceived by the main antenna 204 and may appear as an induced current on the secondary antenna 210. The detected induced current value may be used to adjust the impedance matching circuit 206 to a desirable impedance value. This indirect way of estimating input impedance mismatches is less intrusive and has a lower transmission power loss (when compared to an in-circuit measurement) than a direct VSWR measurement. In various implementations, the induced current measured on the secondary antenna 210 may be converted to a voltage, VSWR, or other value by the controller prior to determining how to adjust the impedance matching circuit 206 to achieve a desirable impedance value for the main antenna 204. For example, a lookup table may be used to convert a detected induced current value in the secondary antenna 206 to a voltage, VSWR, or other value for comparison by the controller. If the detected induced current is different (e.g., more or less) than expected, then the controller 208 acts to modify the impedance matching circuit to adjust the input impedance of the main antenna 204 and achieve a desired operating state.

In one implementation, measurements of induced currents in the secondary antenna are taken for a reference signal. These measurements are then used to reconfigure the system's impedance value to achieve a maximum range and increase the overall system performance. Since the transmission frequency of the RFID reader 202 is known, the transmitted signals from the RFID reader 202 may be used as the reference signal to obtain the measurements. Thus, the controller 208 may use the signals (of known frequency) being transmitted from the main antenna 204 to obtain the induced current measurements and adjust the impedance matching circuit accordingly.

Digitally Controlled Variable Capacitor

Another feature of the invention provides an automated, adjustable capacitance matching circuit to adjust the impedance of an antenna. The adjustable capacitance matching circuit may include a digitally controlled capacitor and two adjustable capacitors. When the measured or inferred VSWR for a system changes, a control circuit adjusts the digital capacitor to set the best value for a desired impedance match of the antenna. The control circuit may use a fast algorithm to set the system parameters and restore communications over the reconfigured antenna.

Figure 3:
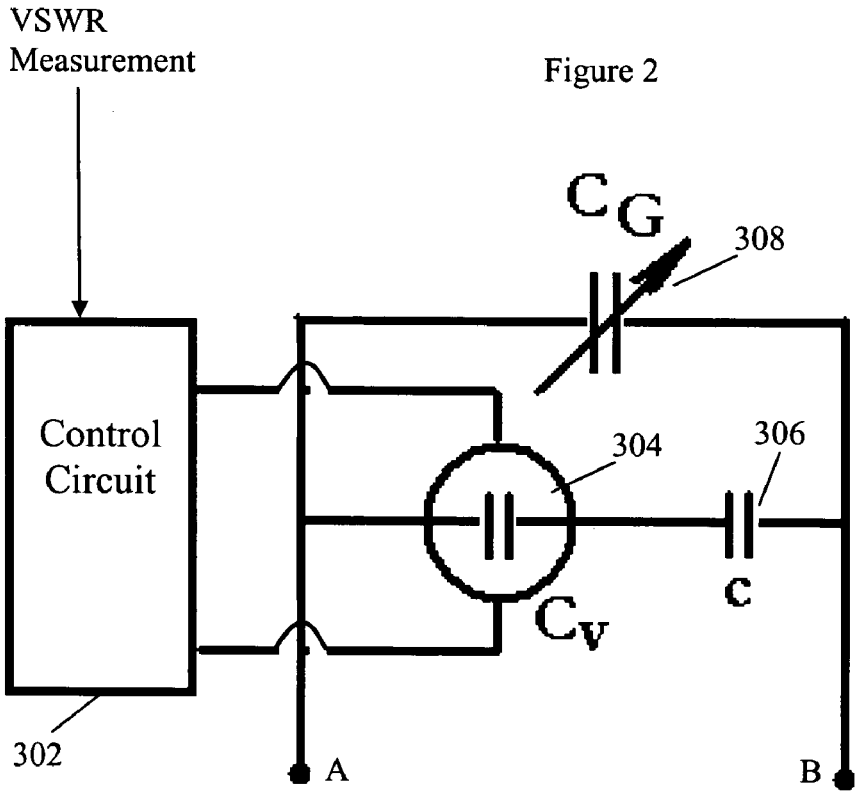
FIG. 3 illustrates a diagram of a variable capacitor circuit used to adjust the impedance of a self-tuning antenna system.

FIG. 3 illustrates a diagram of a variable capacitor circuit used to adjust the impedance of a self-tuning antenna system. The control circuit 302 is coupled to a digital variable capacitor $C_V$ 304 and two adjustable capacitors C 306 and $C_G$ 308 as shown. The equivalent capacitance $C_{eq}$ of the circuit is given by:

$$C_{eq}(C_v) = C_G + \frac{C_v}{1 + C_v/c},$$

where $C_G$ is a central capacitance, C is a series capacitance, and $C_V$ is a digital variable capacitor. The equivalent capacitance $C_{eq}$ can be viewed as a modulation of the central capacitance $C_G$ with the amplitude regulated by C. For a large range of possible capacitance amplitudes of C, $C_G$ and $C_V$ can be adjusted so that the equivalent capacitance $C_{eq}$ fulfills the expected range of variation of the self-tuning system. If the minimum capacitance range (capacitance step) is δC and the maximum capacitance value is ΔC, then the total number of capacitive divisions is ΔC/δC. If a set of N binary channels (e.g., select lines on the digital capacitor) are used to provide such a variation, then the total number of bits are $\log_2(\Delta C/\delta C)$.

When the system VSWR changes, the control circuit 302 acts on the digital variable capacitor $C_V$ 304 to set the best value for impedance matching. The total equivalent capacitance $C_{eq}$ is measured across terminals A and B. The control circuit 302 uses electronic components or a processor with a fast algorithm to set the system and restore communications over the main antenna. In one implementation, terminal A may be coupled to one end of a loop antenna while terminal B may be coupled to the other end of the loop antenna, to thereby affect the input impedance of the antenna.

Figure 4:
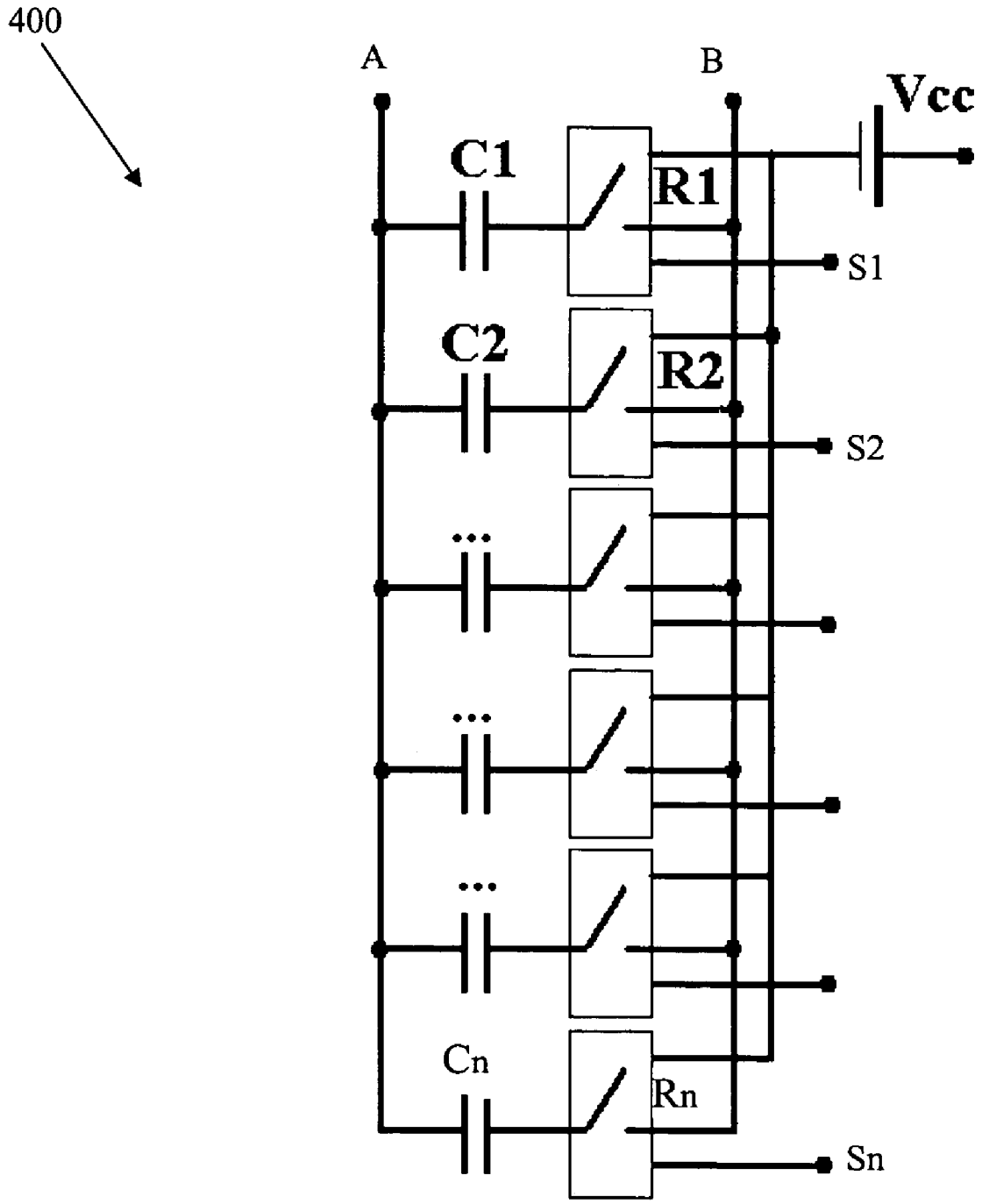
FIG. 4 illustrates a digital variable capacitor circuit that may be used to adjust the input impedance of an antenna according to one embodiment of the invention.

FIG. 4 illustrates a digital variable capacitor circuit 400 that may be used to adjust the input impedance of an antenna according to one embodiment of the invention. In various implementations, the digital variable capacitor circuit 400 may be employed in the circuits illustrated in FIGS. 1, 2, and/or 3. For example, capacitor circuit 400 may be digital variable capacitor 304 (FIG. 3) or part on an input impedance matching circuit for antennas 104 (FIG. 1) and/or 204 (FIG. 2).

Digital variable capacitor circuit 400 includes a plurality of capacitors C1, C2, and Cn (where n is the number of capacitors in the circuit) coupled in parallel. Relays R1, R2, and Rn are positioned in series with the parallel capacitors C1, C2, and Cn to individually couple or remove the plurality of capacitors from the circuit 400. The relays R1, R2, and Rn may be coupled to a power source Vcc and a respective select line S1, S2, and Sn. Depending on the state of select lines S1, S2, and Sn, the corresponding capacitor C1, C2, and Cn is Open or Closed. For example, the select lines S1, S2, and Sn may be individually controlled by a control circuit to couple them to Ground to Close the respective relay R1, R2, or Rn and to Vcc to Open the respective relay. The capacitance range that can be achieved by the digital variable capacitor circuit 400 depends on the number of individual capacitors C1, C2, and Cn controlled and their capacitance configuration (linear, geometric, logarithmic, etc.). The control circuit can selectively adjust one or several of the relays R1, R2, and Rn at the same time to provide a desired overall capacitance across terminals A and B. In one implementation, terminals A and B may be coupled across two ends of a transmitting loop antenna.

As the operating frequencies of the signals through the antenna increase, the use of conventional commercially-available capacitors, connected as shown in FIG. 4, does not comply with the capacitor laws due to stray fields and non-trivial AC capacitance (which acquires a reactance component as the frequency changes). The digital variable capacitor circuit 400 may therefore be optimized to provide a step-by-step variance of capacitances throughout a wide range of frequencies with minimum reactance across a frequency range (e.g., <1 GHz). Each capacitor position and dimension and their relative position in relation to each other and the relays may be calculated to optimize the particular design objectives of an application.

In one implementation, a digital variable capacitor is layered or embedded on a printed circuit board (PCB) and has a purely or largely reactive input impedance (no resistive part), operates at high frequencies, has high-voltage capabilities, and has precision in a desired frequency or range. The digital variable capacitor may be implemented as a parallel plate capacitor having a single dielectric layer.

A digitally controlled variable capacitor embedded on a PCB provides a step-by-step variation of capacitance with minimal residual stray inductance and offers several advantages over conventional capacitors. A continuous capacitance variation is not needed since the digital variable capacitor can adjust the interval of capacitance (here called capacitive band) to any discrete set of capacitance values filling that interval would be sufficient.

Figure 5:
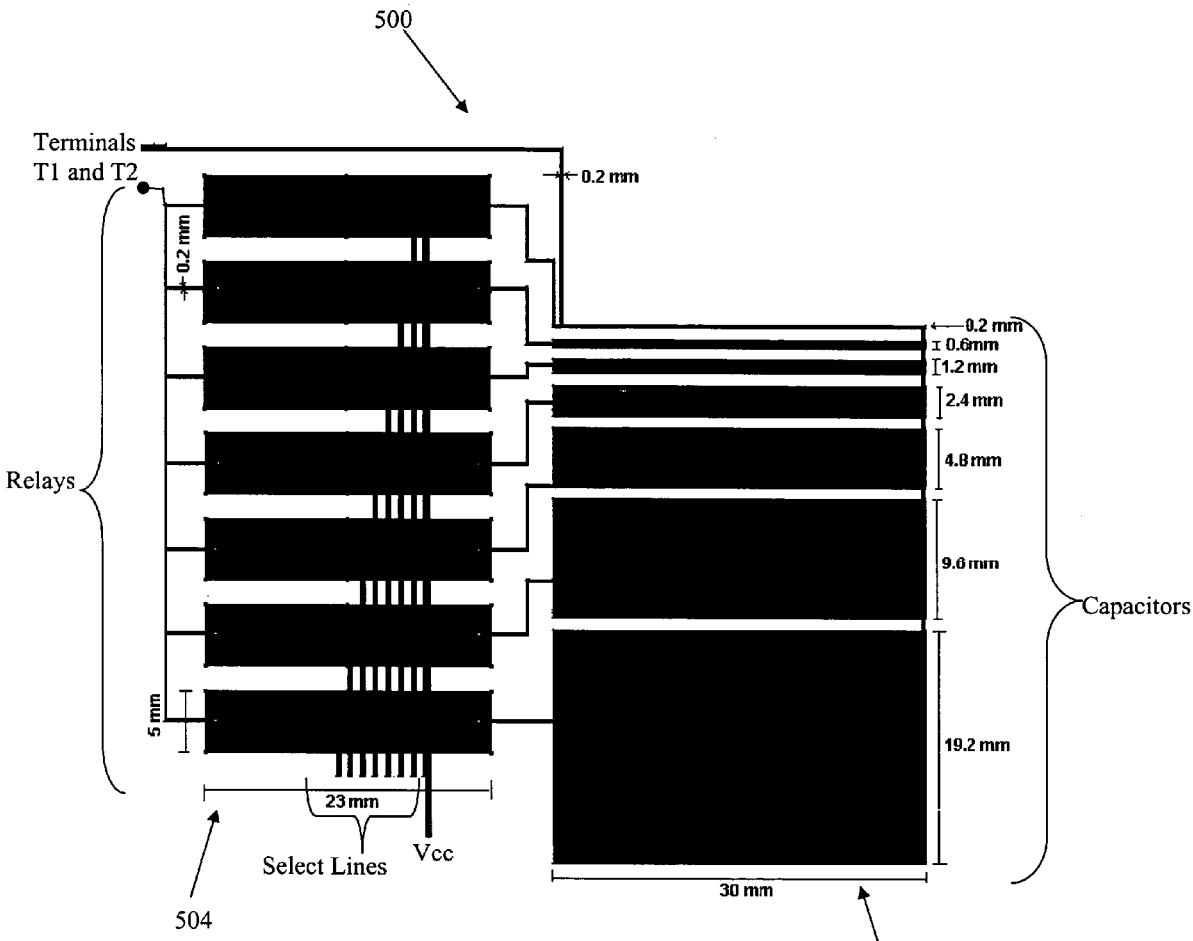
FIGS. 5 and 6 are top and bottom views of a printed circuit board (PCB) layer structure used to build a digitally controlled variable capacitor according to one implementation of the invention.
Figure 6:
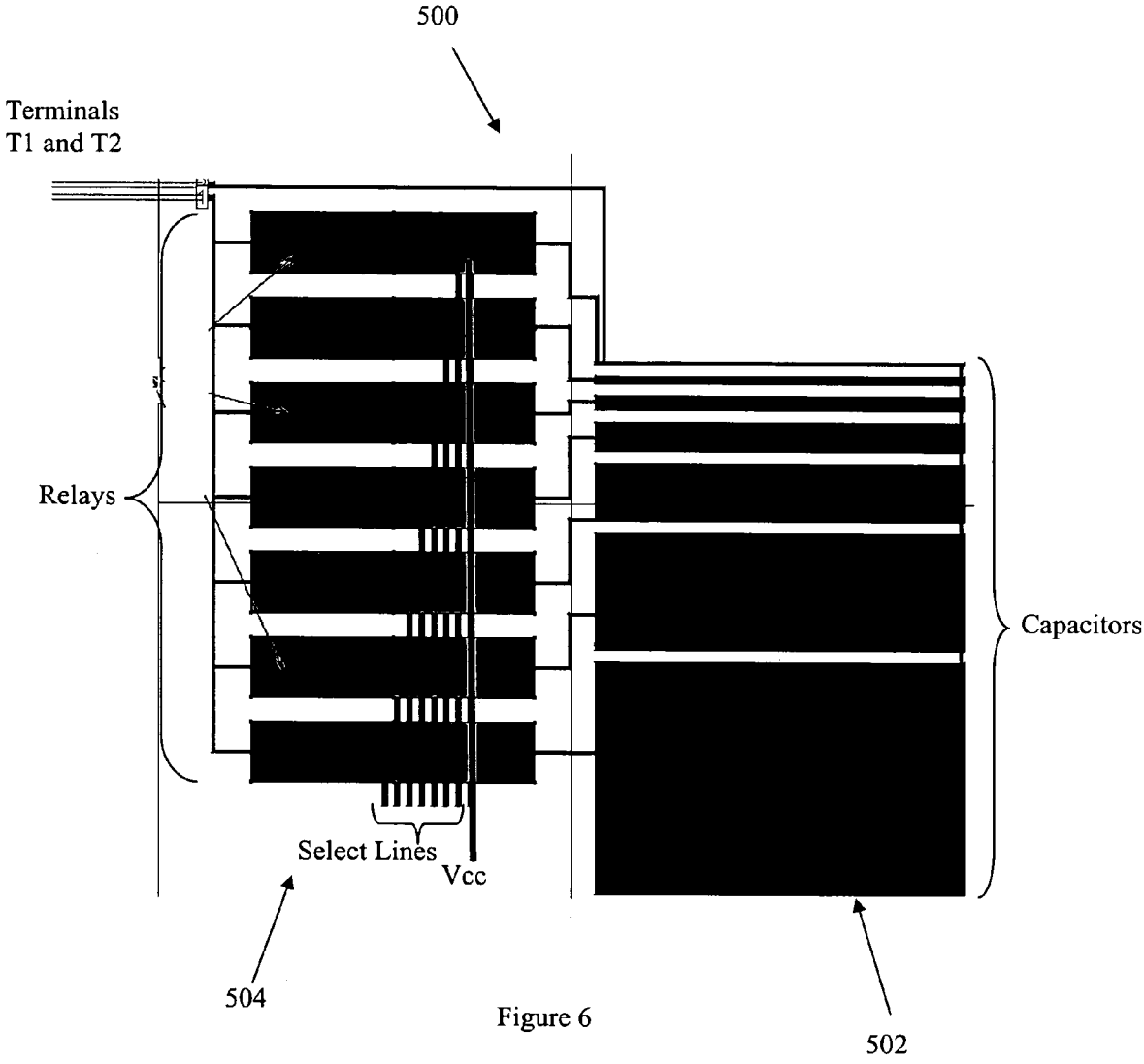

FIGS. 5 and 6 are top and bottom views of a PCB layer structure used to build a digitally controlled variable capacitor 500 according to one implementation of the invention. A plurality of parallel plate capacitors 502 are formed on a single dielectric layer (i.e., the PCB layer) sandwiched between the capacitor plates. That is, the digitally controlled variable capacitor 500 illustrated in FIGS. 5 and 6 may be layered on opposite sides of a PCB. For instance, a top layer, illustrated in FIG. 5, may be on one side of the PCB while the bottom layer, illustrated in FIG. 6, may be on the other side of the PCB. The PCB material acts as the dielectric material for the capacitor layers on either side of the PCB.

A sequence of rectangular plates represents the capacitors 502 which are connected in parallel. In the example shown in FIGS. 5 and 6, seven relays are employed and the theoretical number of capacitance levels is, therefore, 128. The physical dimensions of the plate capacitors may vary depending on the implementation. For example, FIGS. 5 and 6 illustrate seven plate capacitors of different dimensions so that their capacitances have a linear, geometric, and/or logarithmic relationship. In one embodiment, the capacitors may have the approximate dimensions specified in FIG. 5. However, the dimensions illustrated therein are only exemplary and various embodiments of the invention may have different dimensions. One aspect of the invention provides that the capacitor areas on both layers (e.g., top and bottom layers) are the same or approximately the same.

A select line for each relay 504 allows the activation and/or deactivation of one or more specific capacitors 502 to increase or decrease overall capacitance as needed. Each relay 504 is connected in series to at least one of the parallel capacitors 502. The relays 504 are coupled to a constant voltage Vcc and can be individually controlled by an external control circuit through the select lines. When a relay 504 is Closed, the resulting capacitance across terminals T1 and T2 increases accordingly. On the other hand, when a relay 504 is Open, the overall capacitance across terminals T1 and T2 decreases. As it is expected from the basic laws of AC circuits (e.g., up to 100 MHz), the resulting combination of capacitances in achieved by the digital variable capacitor 500 is additive.

The mutual influence of the closely located capacitor structures as shown in FIGS. 5 and 6 may contribute to the existence of parasitic impedances, mainly capacitive and inductive. These impedances are such that the resulting capacitance is not a simple sum of individual capacitances but also exhibit non-imaginary components in the impedance plane. To counter this problem, the dimensional and spacing of the capacitors 502 may be selected to minimize such parasitic impedances.

Figure 7:
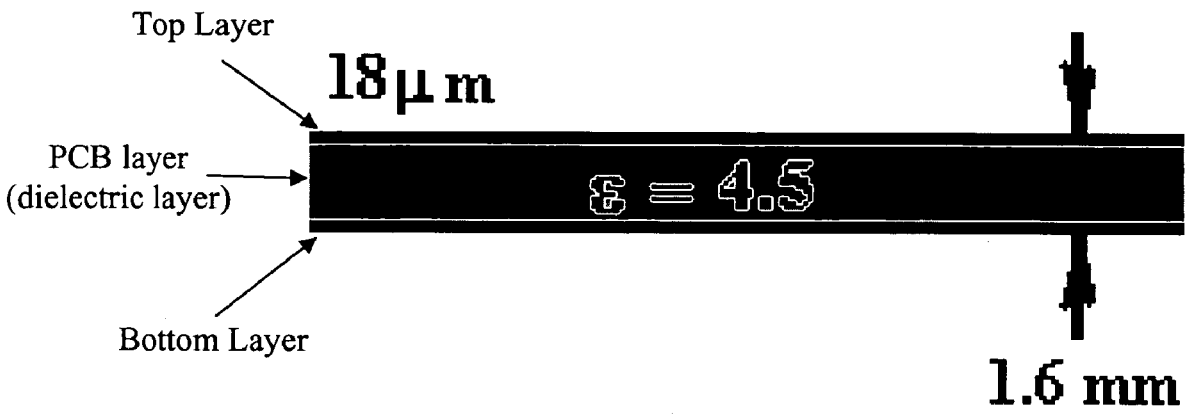
FIG. 7 illustrates a parallel plate capacitor for a digital variable capacitor according to one embodiment of the invention.

FIG. 7 illustrates a parallel plate capacitor for a digital variable capacitor according to one embodiment of the invention. The overall parallel plate capacitor thickness is approximately 1.6 mm and is formed by a dielectric material having a particular dielectric constant (e.g., electric permittivity $\in$=4.5) sandwiched between two metallic plates, each metallic plate being approximately 18 microns thick. The tangent loss factor is assumed zero. Note that the dimensions illustrated in FIG. 7 are exemplary dimensions and other PCB, metallic plate dimensions and/or dielectric coefficients may be used without departing from the invention.

Figure 8:
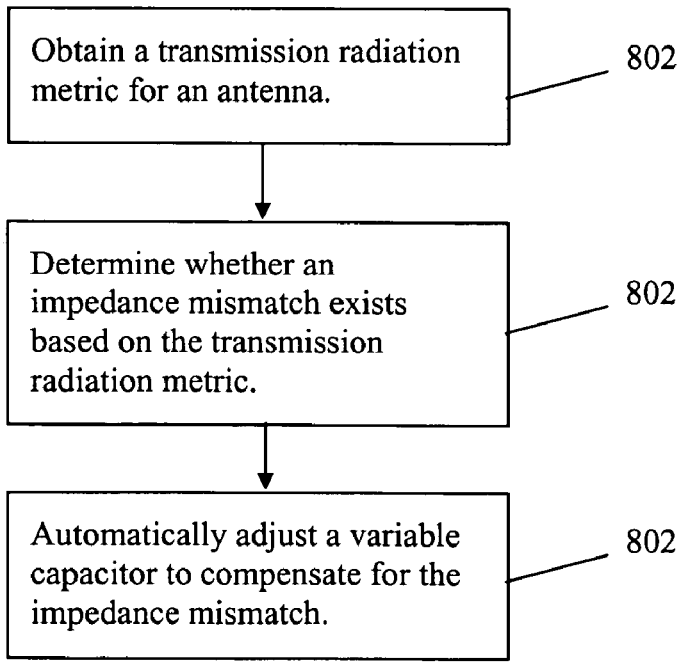
FIG. 8 is a flow diagram illustrating a method for automatically adjusting a self-tuning antenna according to one embodiment of the invention.

FIG. 8 is a flow diagram illustrating a method for automatically adjusting a self-tuning antenna according to one embodiment of the invention. A transmission radiation metric is obtained for an antenna 802. This may be done by obtaining a direct measurement of the VSWR (e.g., coupling a VSWR meter directly to a transmission line to the antenna) or inferring a VSWR value from the antenna radiation. Alternatively, this may be done by an indirect measurement of an induced current on an adjacent secondary antenna. Using this transmission radiation metric, a determination is made as to whether an impedance mismatch exists 804. That is, if the VSWR is greater than "1" then a mismatch exists. Or the induced current value can be compared to threshold values to determine whether a mismatch exists. The system then automatically adjusts a variable capacitor to modify the input impedance for the antenna and compensate for the impedance mismatch 806.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications are possible. Those skilled, in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

What is claimed is:

1. A self tuning antenna comprising:

a main antenna;

an impedance compensation circuit coupled to the main antenna to vary the input impedance of the main antenna; and a controller coupled to the main antenna and impedance compensation circuit to automatically determine when an impedance mismatch occurs on the main antenna and automatically adjust the impedance compensation circuit to minimize the impedance mismatch, wherein the impedance compensation circuit includes a digital variable capacitor that is adjusted by the controller to minimize impedance mismatch, the digital variable capacitor includes a plurality of individually controllable parallel plate capacitors that are added or removed from the impedance compensation circuit by the controller.

2. The self tuning antenna of claim 1 wherein the controller periodically or continuously monitors one or more dynamic characteristics of the main antenna to determine if the input impedance of the main antenna should be adjusted.

3. The self tuning antenna of claim 1 wherein the digital variable capacitor includes a plurality of individually controlled capacitors.

4. The self tuning antenna of claim 1 further comprising:

a voltage standing wave ratio (VSWR) meter coupled to the main antenna to provide a signal to the controller indicative of impedance mismatch for the main antenna.

5. The self tuning antenna of claim 1 further comprising:

a secondary antenna positioned adjacent to the main antenna to sense the electromagnetic radiation in the vicinity of the main antenna and provide a signal indicative of impedance mismatch for the main antenna.

6. The self-tuning antenna of claim 5 wherein the controller senses an induced current on the secondary antenna indicative of the sensed electromagnetic radiation.

7. The self-tuning antenna of claim 5 wherein a transmission signal of known frequency is used to determine the electromagnetic radiation of the main antenna.

8. An antenna tuning device comprising:

an impedance compensation circuit to vary the input impedance of a self-tuning antenna; and a controller coupled to the impedance compensation circuit to automatically adjust the impedance compensation circuit based on a feedback signal, wherein the impedance compensation circuit includes a digital variable capacitor that is adjusted by the controller to minimize impedance mismatch, the digital variable capacitor includes a plurality of individually controllable parallel plate capacitors that are added or removed from the impedance compensation circuit by the controller.

9. The antenna tuning device of claim 8 further comprising:

a voltage standing wave ratio (VSWR) detector to provide the feedback signal to the controller indicative of an impedance mismatch for the antenna.

10. The antenna tuning device of claim 8 further comprising:

a secondary antenna positioned adjacent to the antenna to sense the electromagnetic radiation of the antenna and provide a signal indicative of impedance mismatch for the main antenna; wherein the controller receives the signal from the second antenna and infers a voltage standing wave ratio for the antenna based on the signal.

11. A self tuning antenna apparatus, comprising:

a first antenna;

a second antenna in proximity to the first antenna to capture radio frequency radiations from the first antenna;

a controller coupled to the second antenna to receive a feedback signal from the second antenna and adjust the input impedance of the first antenna to minimize impedance mismatch for the first antenna; and an impedance compensation circuit coupled to the first antenna and the controller, the controller configured adjust the impedance compensation circuit to vary the input impedance of the first antenna, the impedance compensation circuit including a digital variable capacitor including a plurality of individually controllable parallel plate capacitors that are added or removed from the impedance compensation circuit by the controller.

12. An antenna tuning device, comprising:

means for automatically determining whether the antenna has an impedance mismatch; and means for automatically adjusting the input impedance for the antenna and compensate for the impedance mismatch by adjusting a plurality of individually controllable parallel plate capacitors that are added or removed to compensate for the impedance mismatch.

* * * * *